US012258951B2

(12) United States Patent
Li et al.

(10) Patent No.: US 12,258,951 B2
(45) **Date of Patent: *Mar. 25, 2025**

(54) TRANSMISSION ASSEMBLY OF PUMP HEAD OF DIAPHRAGM BOOSTER PUMP, PUMP HEAD OF DIAPHRAGM BOOSTER PUMP, AND DIAPHRAGM BOOSTER PUMP

(71) Applicant: SHENZHEN ANGEL DRINKING WATER INDUSTRIAL GROUP CORPORATION, Guangdong (CN)

(72) Inventors: Guoping Li, Shenzhen (CN); Kai Zhao, Shenzhen (CN); Chunhui Qiu, Shenzhen (CN); Qingyan Chen, Shenzhen (CN); Qizhi Hong, Shenzhen (CN); Heng Zhang, Shenzhen (CN); Jianfang Zhang, Shenzhen (CN)

(73) Assignee: SHENZHEN ANGEL DRINKING WATER INDUSTRIAL GROUP CORPORATION, Shenzhen (CN)

( * ) Notice: Subject to any disclaimer, the term of this patent is extended or adjusted under 35 U.S.C. 154(b) by 309 days.

This patent is subject to a terminal disclaimer.

(21) Appl. No.: 17/917,120

(22) PCT Filed: Jul. 30, 2021

(86) PCT No.: PCT/CN2021/109721

§ 371 (c)(1),
(2) Date: Oct. 5, 2022

(87) PCT Pub. No.: WO2022/134593

PCT Pub. Date: Jun. 30, 2022

(65) Prior Publication Data

US 2023/0184237 A1 Jun. 15, 2023

(30) Foreign Application Priority Data

Dec. 21, 2020 (CN) ..... 202011521313.3
Jun. 4, 2021 (CN) ..... 202110626422.X

(51) Int. Cl.
*F04B 43/02* (2006.01)
*F04B 43/00* (2006.01)
*F04B 53/00* (2006.01)

(52) U.S. Cl.
CPC ..... *F04B 43/026* (2013.01); *F04B 43/0054* (2013.01); *F04B 53/001* (2013.01)

(58) Field of Classification Search
CPC ..... F04B 43/0054; F04B 9/045; F04B 43/04; F04B 43/026; F04B 53/001
See application file for complete search history.

(56) References Cited

U.S. PATENT DOCUMENTS 4,381,179 A * 4/1983 Pareja ..... F04B 9/045 74/44
11,434,902 B2 * 9/2022 Brocker ..... F04B 45/047
(Continued)

FOREIGN PATENT DOCUMENTS

CN 2541625 Y 3/2003
CN 201326534 Y * 10/2009 ..... F04B 25/00
(Continued)

OTHER PUBLICATIONS

International Search Report mailed Oct. 29, 2021, in corresponding to International Application No. PCT/CN2021/109721; 5 pages.
(Continued)

*Primary Examiner* — Nathan C Zollinger
(74) *Attorney, Agent, or Firm* — Maier & Maier, PLLC

(57) ABSTRACT

A transmission assembly for a pump head of a six-cylinder opposed balanced diaphragm booster pump, a pump head of a diaphragm booster pump, and a diaphragm booster pump. The transmission assembly includes an eccentric assembly, a balance wheel assembly, a bearing and swing arms fixed to the balance wheel assembly. The eccentric assembly includes a motor shaft and eccentric wheels, wherein the
(Continued)

movement of two eccentric wheels with a phase difference of 180° drives balance wheels of the balance wheel assembly to move oppositely. The eccentric assembly includes a first eccentric wheel, a second eccentric wheel and a third eccentric wheel in sequence, wherein the first eccentric wheel and the third eccentric wheel are similarly eccentric, and the second eccentric wheel is eccentric in an opposite manner to the first eccentric wheel and the third eccentric. The embodiments reduce noise caused by vibration of an existing diaphragm pump in operation.

15 Claims, 20 Drawing Sheets

(56) References Cited

U.S. PATENT DOCUMENTS

| | | | | |
|---|---|---|---|---|
| 2010/0183462 | A1 | 7/2010 | Kaufmann et al. | |
| 2012/0107150 | A1 | 5/2012 | Pawlak et al. | |
| 2018/0023556 | A1 | 1/2018 | Yan | |
| 2018/0306170 | A1* | 10/2018 | Ottosen | F04B 43/04 |
| 2023/0151804 | A1* | 5/2023 | Li | F04B 43/04 417/395 |
| 2024/0271608 | A1* | 8/2024 | Liu | F04B 43/0054 |

FOREIGN PATENT DOCUMENTS

| | | | |
|---|---|---|---|
| CN | 204061117 | U | 12/2014 |
| CN | 104948568 | A | 9/2015 |
| CN | 205823592 | U | 12/2016 |
| CN | 206816477 | U | 12/2017 |
| CN | 109944781 | A | 6/2019 |
| CN | 210769242 | U | 6/2020 |
| CN | 112696341 | A | 4/2021 |
| JP | 06101632 | A | 4/1994 |
| WO | 2017065685 | A1 | 4/2017 |

OTHER PUBLICATIONS

Chinese Search Report mailed Nov. 29, 2021, in corresponding to Application No. 202110626422.X; 2 pages.
Chinese First Office Action mailed Dec. 3, 2021, in corresponding to Application No. 202110626422.X; 17 pages.
Chinese Supplementary Search Report mailed Apr. 8, 2022, in corresponding to Application No. 202110626422.X; 1 page.
Chinese Second Office Action mailed Apr. 18, 2022, in corresponding to Application No. 202110626422.X; 19 pages.
Chinese Supplementary Search Report mailed Jun. 29, 2022, in corresponding to Application No. 202110626422.X; 1 page.
Zhi Gao et al., "Theory of Machines and Mechanisms, 2nd Edition", Published: Jan. 31, 2015, pp. 250-252, 12 pgs.
Office Action issued on Nov. 21, 2024, in corresponding Korean Application No. 10-2023-7022291, 22 pages.

* cited by examiner

TRANSMISSION ASSEMBLY OF PUMP HEAD OF DIAPHRAGM BOOSTER PUMP, PUMP HEAD OF DIAPHRAGM BOOSTER PUMP, AND DIAPHRAGM BOOSTER PUMP

TECHNICAL FIELD

The application relates to the technical field of water treatment, in particular to a transmission assembly of a pump head of a diaphragm booster pump, a pump head of a diaphragm booster pump, and a diaphragm booster pump.

BACKGROUND

At present, the volume of a commonly used diaphragm booster pump is changed through the periodic movement of a diaphragm, so that a rubber valve is driven to periodically close and open a water inlet and a water outlet in a valve seat to realize pressure boosting.

A motor of the diaphragm booster pump drives an eccentric wheel to rotate. Balance wheels cannot rotate due to restriction, so the three balance wheels can only reciprocate axially in turn, and a deformation area of the diaphragm will make synchronous axial expansion or compression movement under the action of the axial reciprocating movement of the balance wheels. When a piston actuation area of the diaphragm moves in an expansion direction, a water inlet check valve opens, and source water is sucked into a booster water chamber through the water inlet. When the deformation area of the diaphragm moves in a compression direction, a drainage check valve opens, and pressurized water is pressed out, enters a high-pressure water chamber through the water outlet, and then is discharged out of the pump through a drainage hole in a pump head cover, so as to provide required high-pressure water.

Structural diagrams of an existing diaphragm booster pump are shown in FIGS. 1-2. The existing diaphragm booster pump has the following disadvantages: a motor drives an eccentric wheel to rotate, and the eccentric wheel exerts an axial force on a diaphragm; the eccentric wheel is unevenly stressed and changes periodically, and the rotation produces vertical vibration; and the vibration and noise are not obvious when the rotation speed is below 800 rpm, but are very strong when the rotation speed is high (according to existing products in the market, the rotation of the motor drives the eccentric wheel, the eccentric wheel and a motor shaft are axially eccentric by 1 mm, and an axial angle between the eccentric wheel and the motor is 2.4°; in this way, the vertical vibration caused by rotation is not noisy when the rotation speed is below 800 rpm, but the vibration and noise are very strong when the rotation speed is high). Therefore, an existing diaphragm pump structure is not suitable for an RO pump with a large flow rate (the rotation speed is over 1300 rpm). A flow rate of the existing diaphragm booster pump is small. To increase the flow rate, it is necessary to increase a motor speed or a volume of a pump body. The increase of the motor speed will cause more serious vibration and noise problems, and the increase of the volume will make it difficult for the booster pump to fit existing equipment.

The demand for flow rate is becoming increasingly higher in the water treatment process. However, the existing diaphragm booster pump structure is not suitable for pumps with large flow rates. To increase the flow rate of the diaphragm booster pump, it is necessary to increase the motor speed or the volume of the pump body. Serious vibration and noise problems will be caused no matter whether the motor speed is increased or the volume of the pump body is increased, which is the bottleneck of the prior art, and there is no effective solution at present.

For example, an U.S. patent application, publication No. US20070297926A1, entitled "Multi-Stage Diaphragm Pump", comprises a pump body, a main shaft, a reciprocating movement driving mechanism controlled by the main shaft, and a driving shaft connected to the mechanism and placed in a working chamber of the pump body, wherein a plurality of disc diaphragms connected in series are arranged on the driving shaft, a piston with a sealing ring is fixed to a front side of each disc diaphragm, a space between two disc diaphragms is filled with a hydraulic medium, and one of the pistons is in direct contact with materials in the working chamber which is provided with a suction check valve and a discharge check valve inside.

However, this multi-stage diaphragm pump, when applied to household water treatment equipment, is bulky, complicated in structure and high in cost. Moreover, in the case of large water flow, the vibration and noise problems still exist.

Another example is a patent application, publicaiton No. GB2524863A, entitled "Vibration-reducing method for compressing diaphragm pump". A vibration-reducing unit for shortening a swinging moment is arranged between a pump head block and a diaphragm. The vibration-reducing unit for shortening the swinging moment can reduce a moment exerted by a balance wheel on a piston actuation area, thus achieving the effect of denoising the diaphragm booster pump. The vibration-reducing unit for shortening the swinging moment reduces the moment exerted by the balance wheel on the piston actuation area by shortening an arm of force exerted by the balance wheel on the piston actuation area, and comprises a pump head block actuating and fixing part and a diaphragm actuating and fixing part, wherein the pump head block actuating and fixing part is arranged on the pump head block and the diaphragm actuating and fixing part is arranged on the diaphragm, and the pump head block actuating and fixing part and the diaphragm actuating and fixing part are connected to shorten the arm of force exerted by the balance wheel, thereby reducing an actuation amplitude of the piston actuation area.

The technical problem of this patent application is still that the eccentric wheel exerts an axial force on the diaphragm, resulting in unbalanced stress on the eccentric wheel and vertical vibration, which is a technical bottleneck that traditional axial force application schemes cannot overcome.

SUMMARY

In order to overcome the technical problems existing in the prior art, the application provides a pump head of a diaphragm booster pump, a diaphragm booster pump and a water processor, to solve the problems of large vibration noise and small flow of existing diaphragm booster pumps.

The technical solution of the invention is as follows.

A transmission assembly of a pump head of a diaphragm booster pump comprises an eccentric assembly, a balance wheel assembly, a bearing and swing arms fixed to the balance wheel assembly; and the eccentric assembly comprises a motor shaft and eccentric wheels, and a movement of two eccentric wheels with a phase difference of 180° drives balance wheels of the balance wheel assembly to move oppositely.

During rotation of the eccentric assembly, eccentric forces counteract each other, and moment balance is realized.

A resultant force of radial eccentric forces generated by an eccentric movement of the balance wheel assembly is zero, and resultant moment balance is realized.

The eccentric assembly comprises a first eccentric wheel, a second eccentric wheel and a third eccentric wheel in sequence, the first eccentric wheel and the third eccentric wheel are similarly eccentric, and the second eccentric wheel is eccentric in an opposite manner to the first eccentric wheel and the third eccentric.

The balance wheel assembly comprises a big balance wheel and small balance wheels, which are a first small balance wheel, the big balance wheel and a second small balance wheel in sequence, and the eccentric assembly drives the balance wheel assembly to swing eccentrically through the bearing.

A part of the swing arms are fixed to the small balance wheels, and another part of the swing arms are fixed to the big balance wheel to form a split structure.

The small balance wheels and the big balance wheel simultaneously deviate from or move towards an axial center of the motor shaft, forces in a radial direction counteract each other, and a resultant force is zero.

The balance wheel assembly drives booster chambers to expand or compress radially, and the booster chambers are connected to a diaphragm and a piston chamber.

Two booster chambers oppositely arranged around a center point of the piston chamber form a pair, and center lines of the pair of the booster chambers are on a same diameter line of the piston chamber.

At least three pairs of the booster chambers expand or compress in sequence.

The booster chamber completes one expansion and compression cycle every time the motor shaft rotates by one circle.

A radial reciprocating movement of the balance wheels of the balance wheel assembly drives the diaphragm to be radially deformed, so that the booster chamber expands or compresses radially.

A contact part between the diaphragm and the balance wheel is a deformation area of the diaphragm, and the deformation area of the diaphragm is deformed.

When thin parts of the first eccentric wheel and the third eccentric wheel rotate to the balance wheels linked therewith, the small balance wheel pushes the deformation area of the diaphragm corresponding to the small balance wheel be near a center point of the piston chamber, and a volume of the booster chamber corresponding to the small balance wheel is the largest; and an eccentric position of the second eccentric wheel is opposite to eccentric positions of the first eccentric wheel and the third eccentric wheel, so when a thin part of the second eccentric wheel rotates to the big balance wheel linked therewith, the corresponding deformation area of the diaphragm is near the center point of the piston chamber, and the volume of the booster chamber is the largest.

When thick parts of the first eccentric wheel and the third eccentric wheel rotate to the small balance wheel linked therewith, the deformation area of the diaphragm corresponding to the balance wheel is away from the center point of the piston chamber, and the volume of the booster chamber is the smallest; and when a thick part of the second eccentric wheel rotates to the big balance wheel linked therewith, the corresponding deformation area of the diaphragm is away from the center point of the piston chamber, and the volume of the booster chamber is the smallest.

When the diaphragm moves in an expansion direction, a water inlet check valve opens and source water is sucked into the booster chambers; and when the diaphragm moves in a compression direction, a water outlet check valve opens and pressurized water is discharged.

A pump head of a diaphragm booster pump comprising the transmission assembly is provided.

A diaphragm booster pump comprising the pump head of a diaphragm booster pump is provided.

According to one embodiment of the invention, a method of operating the pump head of the diaphragm booster pump is as follows: the transmission unit drives the deformation area of the diaphragm to expand or compress radially; during the rotation of the eccentric assembly, eccentric forces counteract each other, and moment balance is realized; a resultant force of radial eccentric forces generated by the eccentric movement of the balance wheel assembly is zero, and resultant moment balance is realized, so that the booster chambers expand or compress radially; when the deformation area of the diaphragm moves in the expansion direction, the water inlet check valve opens, and source water is sucked into the booster chambers from a water inlet chamber via a water inlet; and when the deformation area of the diaphragm moves in the compression direction, the water outlet check valve opens, and pressurized water is pressed out, enters a water outlet chamber through a water outlet, and is discharged from the water outlet chamber.

According to one embodiment of the invention, in the method, a plurality of booster chambers are arranged opposite to each other around the center point of the piston chamber in a centripetal manner, two opposite booster chambers form a pair and are driven by the eccentric assembly, and the plurality of pairs of booster chambers expand or compress in sequence.

The invention realizes technical breakthroughs in fields including but not limited to domestic drinking water, fundamentally changes axial force exertion by balance wheels of a traditional diaphragm booster pump on a diaphragm, completely changes axial deformation of the diaphragm into radial deformation, and realizes the driving of water flow through the radial deformation of the diaphragm. Compared with traditional diaphragm booster pumps, the radial deformation of the diaphragm can effectively increase the deformation area of the diaphragm and a variable volume of the booster chamber without changing a volume of a pump body and a rotation speed of a motor, so as to increase a flow rate of the diaphragm booster pump. Further, during the rotation of the eccentric assembly, eccentric forces counteract each other, and moment balance is realized; and a resultant force of radial eccentric forces generated by the eccentric movement of the balance wheel assembly is zero, and resultant moment balance is realized, thus greatly reducing vibration and noise and achieving a relatively silencing effect. With the increase of the rotation speed or the volume of the pump head, vibration and noise are greatly reduced, and the vibration and noise problems restricting large-flow diaphragm booster pumps is solved fundamentally.

BRIEF DESCRIPTION OF THE DRAWINGS

In order to explain the technical solution of the application more clearly, the drawings used in the description of the embodiments will be briefly introduced below. Obviously, the drawings in the following description are only illustrating some embodiments of the application. For those skilled in the art, other drawings can be obtained from these drawings without exceeding the protection scope of this application.

DETAILED DESCRIPTION OF THE EMBODIMENTS

Figure 1:
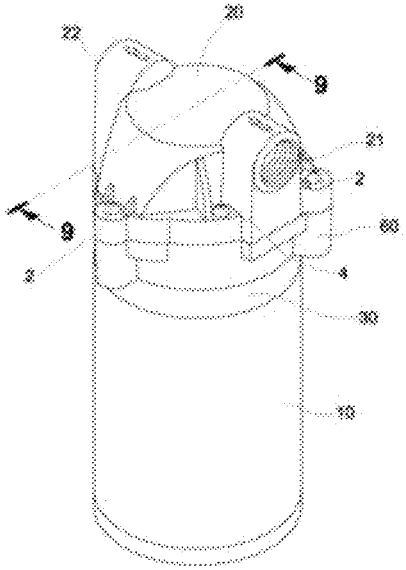
FIG. 1 is a diagram of a diaphragm booster pump in the prior art.
Figure 2:
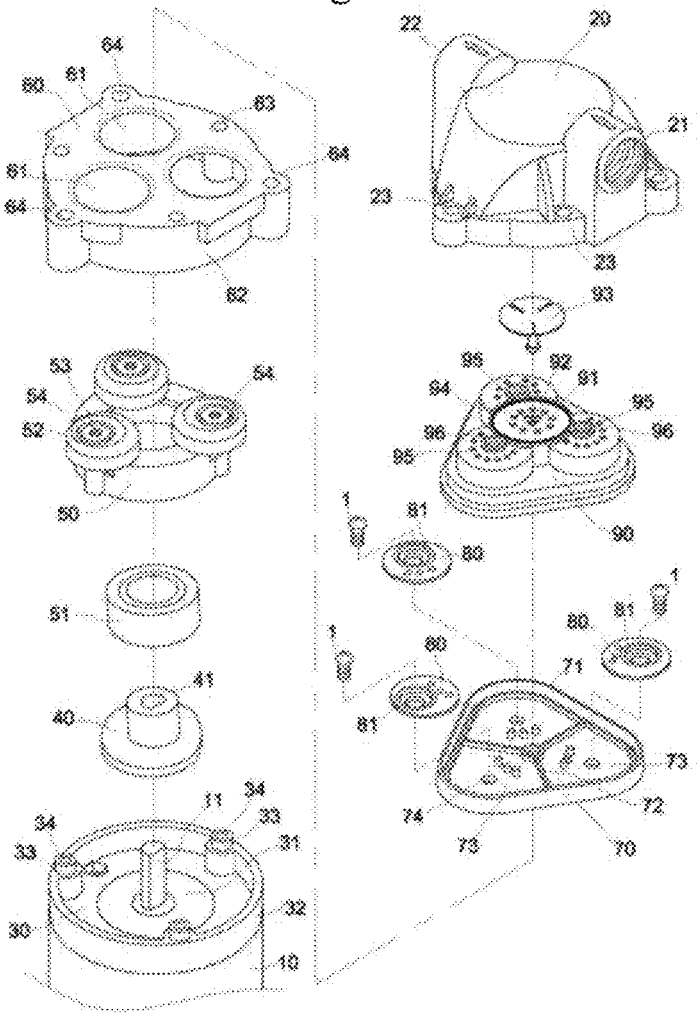
FIG. 2 is an exploded view of a diaphragm booster pump in the prior art.

The technical solution of the application will be described clearly and completely with reference to the drawings in the embodiments of the application. Obviously, the described embodiments are part of the embodiments of the application, not all of them. Based on the embodiments in the application, all other embodiments obtained by those skilled in the art without creative labor are within the scope of protection in the application.

Embodiment 1

Diaphragm booster pump 100, source water 200, pressurized water 300, water outlet block 1, pump head block 2, diaphragm 3, water outlet check valve 4, water inlet check valve 5, piston chamber 6, first eccentric wheel bearing 7, first eccentric wheel 8, first balance wheel 9, second balance wheel 10, second eccentric wheel 11, second eccentric wheel bearing 12, water inlet block 13, motor shaft 14, and motor 15;

First piston chamber 6*a*, second piston chamber 6*b*, third piston chamber 6*c*, water outlet chamber 601, booster chamber 602, water inlet chamber 603, water outlet 604, water inlet 605, first cavity 606, water inlet hole 1301 of water inlet block, and water inlet channel 1302.

Figure 3:
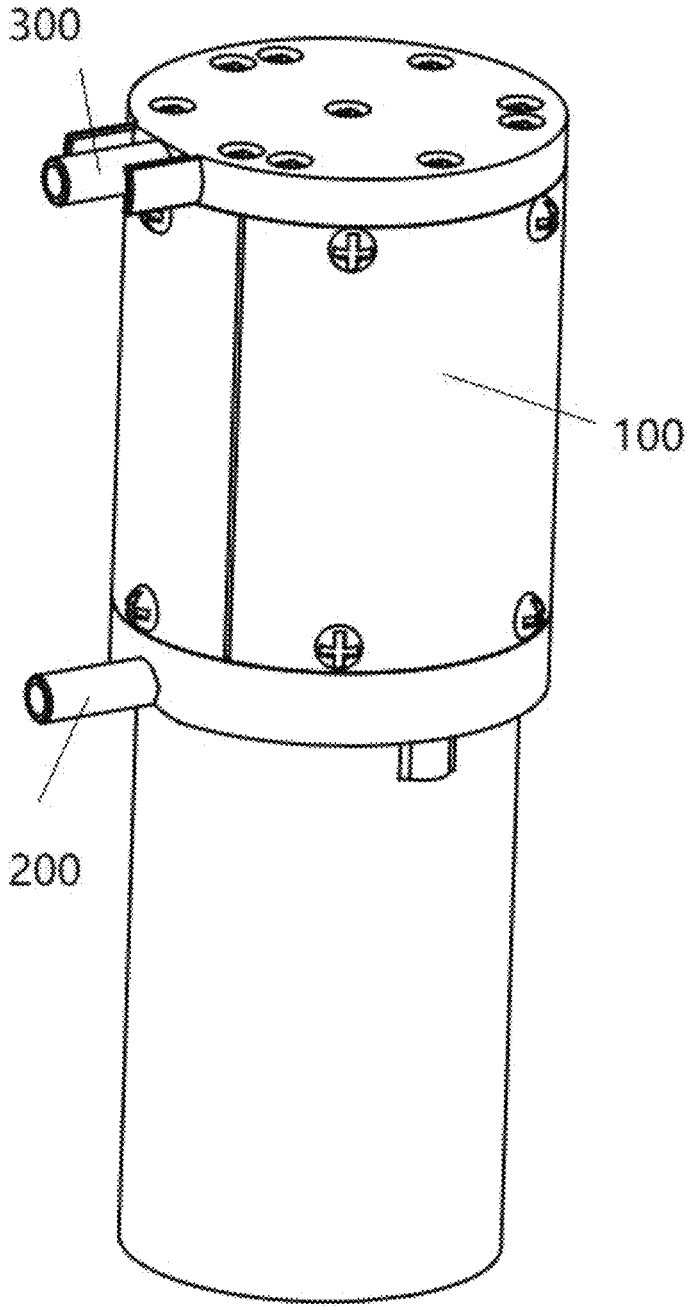
FIG. 3 is a diagram of a diaphragm booster pump according to one embodiment of the invention.
Figure 4:
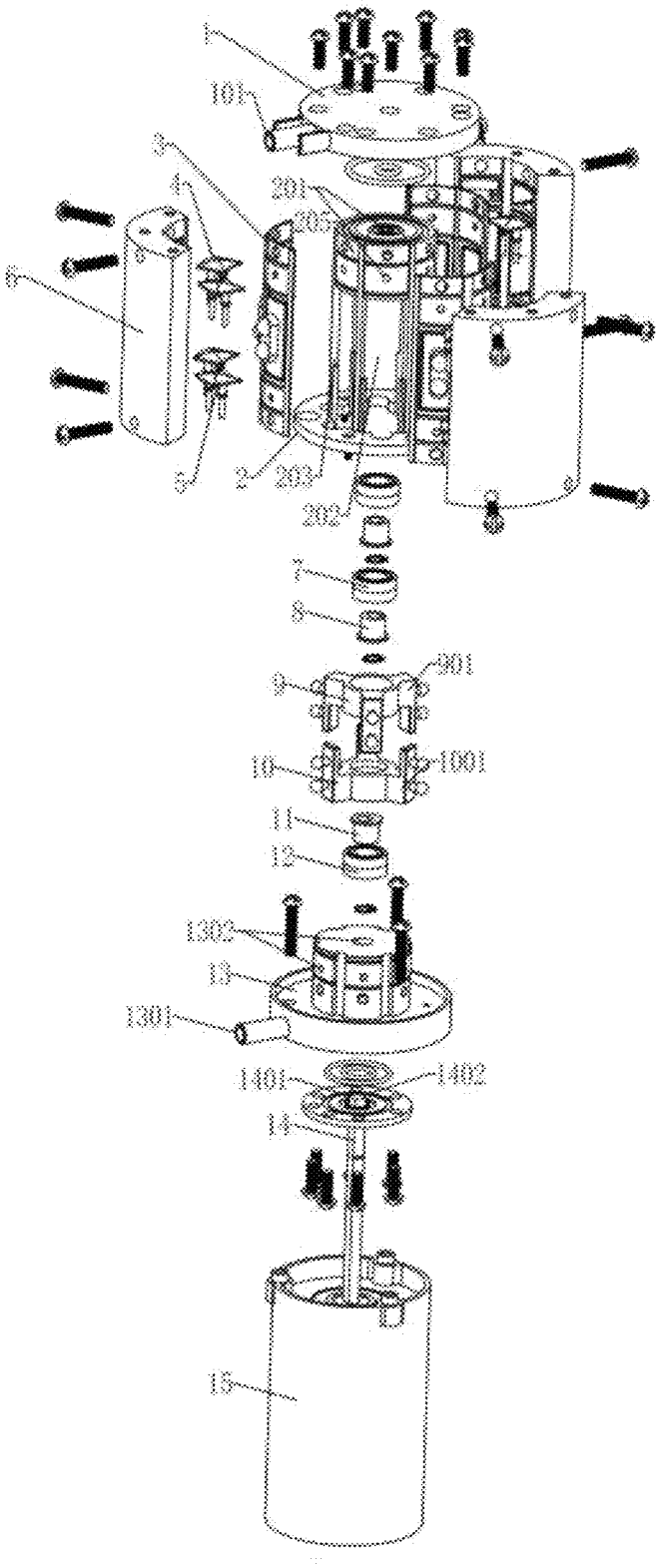
FIG. 4 is an explosion view of a diaphragm booster pump according to one embodiment of the invention.

As shown in FIGS. 3 and 4, this embodiment provides a pump head of a diaphragm booster pump, comprising a piston chamber 6, a diaphragm 3, a first eccentric wheel 8, a second eccentric wheel 11, a first balance wheel 9, a second balance wheel 10, and a motor shaft 14.

An eccentric assembly comprises the motor shaft 14, the first eccentric wheel 8 and the second eccentric wheel 11.

A balance wheel assembly comprises a first balance wheel and a second balance wheel.

The diaphragm booster pump of the present invention realizes the driving of water flow through the radial deformation of the diaphragm 3. Compared with an existing diaphragm booster pump with the same volume, the flow rate is obviously improved, and vibration and noise are reduced.

Figure 7:
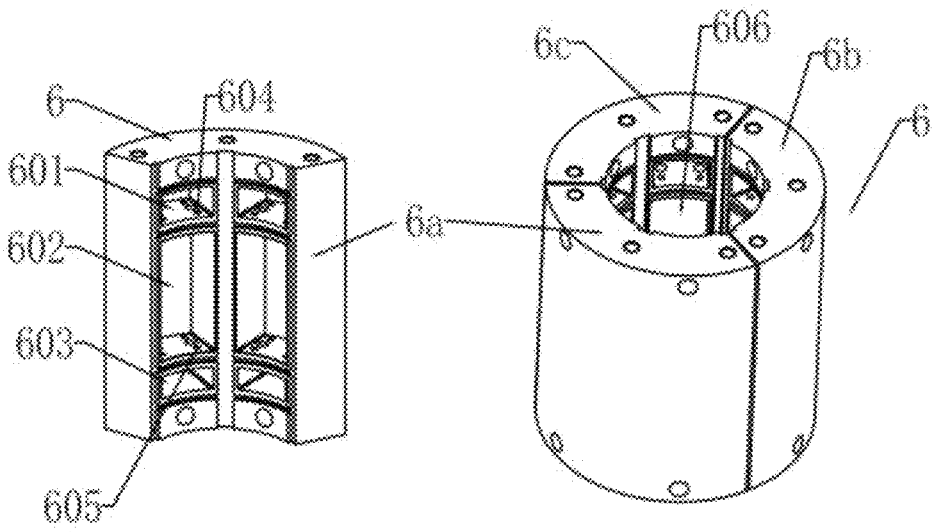
FIG. 7 is a diagram of a piston chamber of a diaphragm booster pump according to one embodiment of the invention.

As shown in FIGS. 4 and 7, the piston chamber 6 is generally in a shape of a hollow annulus or cylinder overall, and the piston chamber 6 comprises one piston chamber assembly or is formed by assembling a plurality of piston chamber assemblies.

In an alternative solution, the piston chamber 6 comprises a first piston chamber 6*a*, a second piston chamber 6*b* and a third piston chamber 6*c* which are fan-shaped or arc-shaped, and the first piston chamber 6*a*, the second piston chamber 6*b* and the third piston chamber 6*c* are assembled into the piston chamber 6. In an alternative solution, the radians of the first piston chamber 6*a*, the second piston chamber 6*b* and the third piston chamber 6*c* are all 120°, and an inner wall of the piston chamber 6 is provided with a water outlet chamber 601, a booster chamber 602 and a water inlet chamber 603.

The water inlet chamber 603 communicates with the booster chamber 602 through a water inlet 605, and optionally, the water inlet chamber 603 is arranged below the booster chamber 602. The booster chamber 602 communicates with the water outlet chamber 601 through a water outlet 604, and optionally, the water outlet chamber 601 is arranged above the booster chamber 602.

Figure 10:
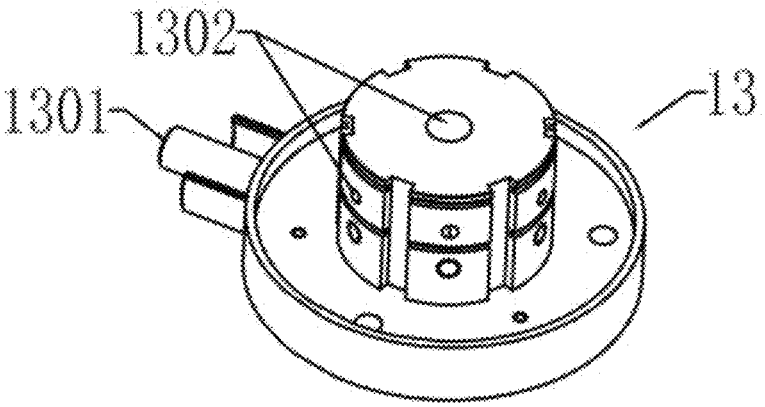
FIG. 10 is a diagram of a water inlet block of a diaphragm booster pump according to one embodiment of the invention.

As shown in FIG. 10, the water inlet block 13 is provided with a water inlet hole 1301 and a water inlet channel 1302 communicating with the water inlet chamber 603.

Figure 11:
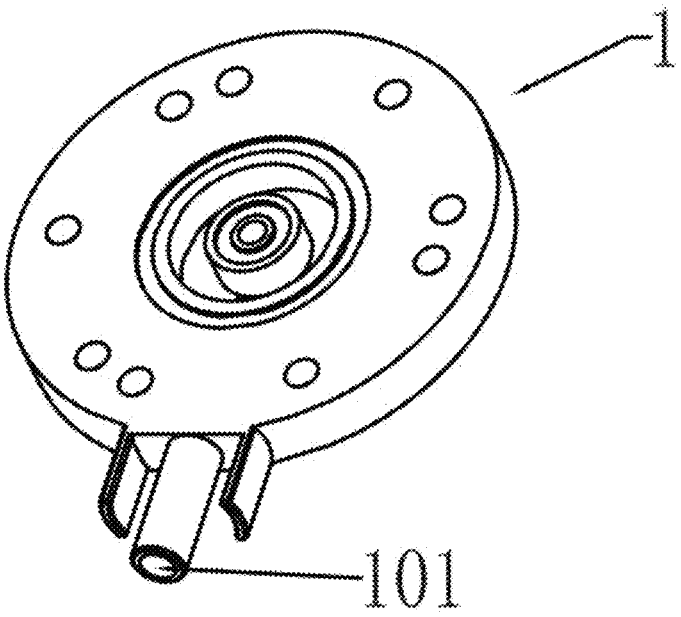
FIG. 11 is a diagram of a water outlet block of a diaphragm booster pump according to one embodiment of the invention.

As shown in FIG. 11, the water outlet block 1 is provided with a water outlet hole 101, and the pump head block 2 is provided with a water outlet channel 201 communicating with the water outlet chamber 601 and the water outlet block 1.

Figure 12:
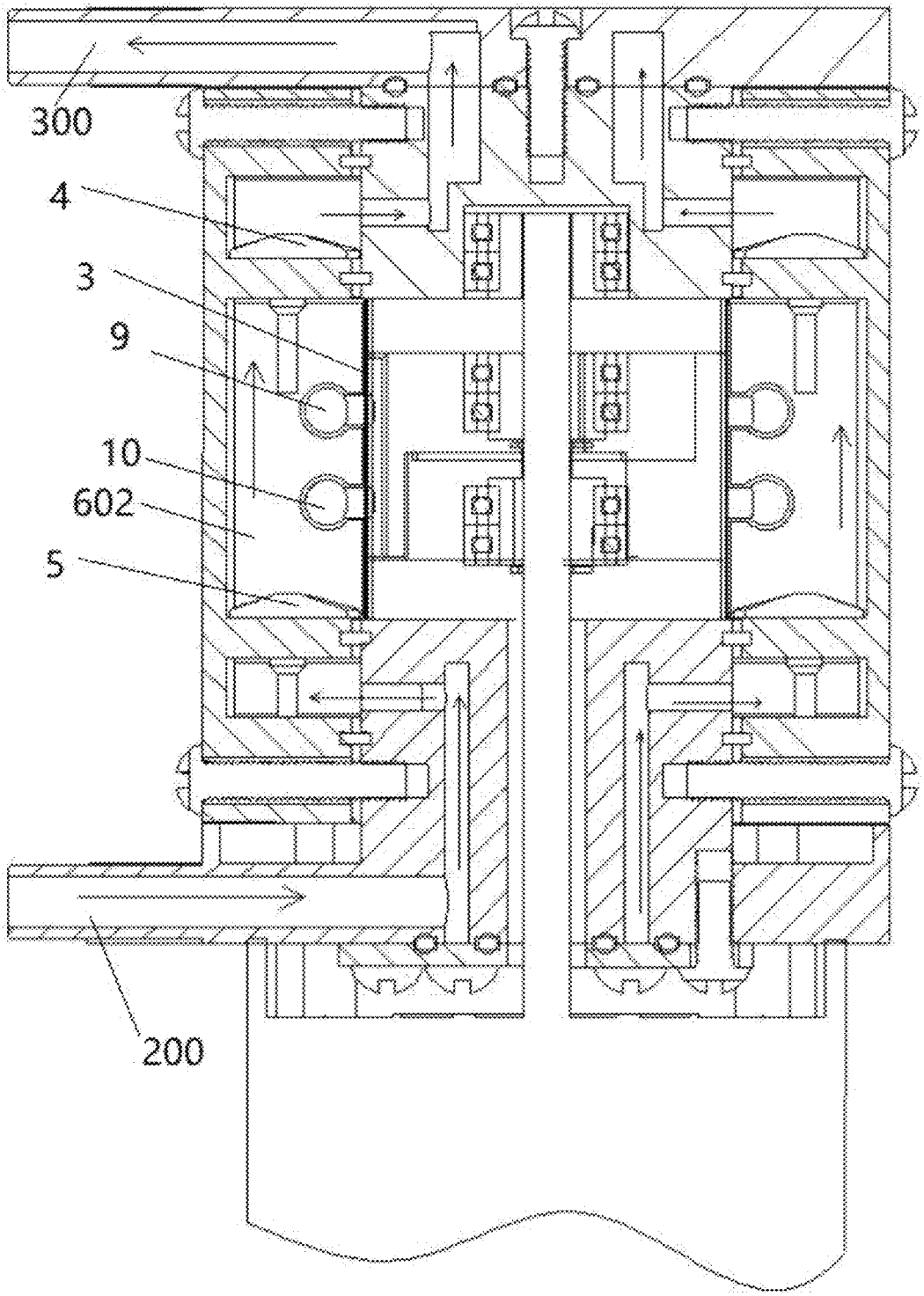
FIG. 12 is a sectional view of a diaphragm booster pump according to one embodiment of the invention.

As shown in FIG. 12, source water enters the water inlet chamber 603 through the water inlet hole 1301 via the water inlet channel 1302, and enters the booster chamber 602 through the water inlet 605. Water in the booster chamber 602 enters the water outlet chamber 601 through the water outlet 604, then enters the water outlet block 1 through the water outlet channel 201, and is finally discharged through the water outlet hole 101.

A water inlet check valve 5 is arranged at the water inlet 605, which only allows water to flow from the water inlet chamber 603 to the booster chamber 602, and the water inlet check valve 5 may be a rubber valve or other suitable valves.

A water outlet check valve 4 is arranged at the water outlet 604, which only allows water to flow from the booster chamber 602 to the water outlet chamber 601, and the water outlet check valve 4 may be a rubber valve or other suitable valves.

Figure 6:
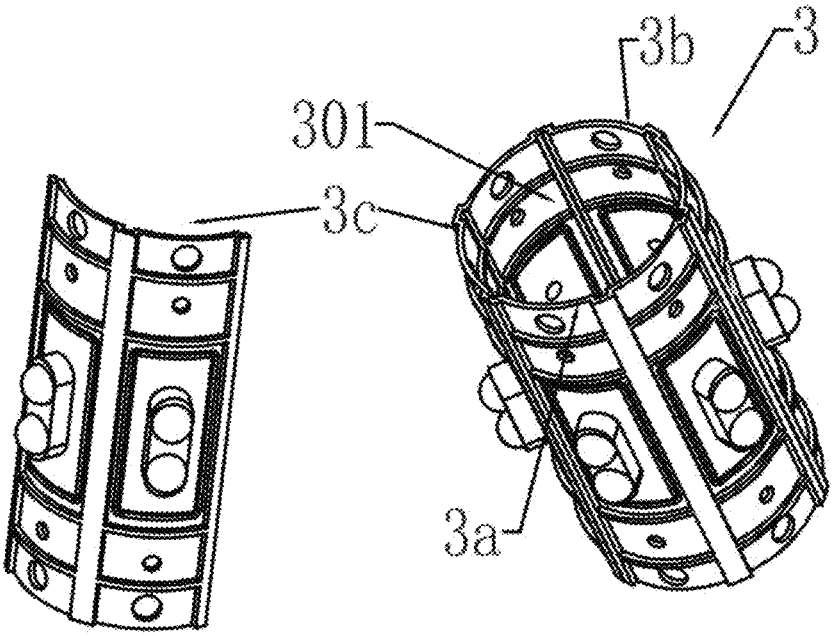
FIG. 6 is a diagram of a diaphragm of a diaphragm booster pump according to one embodiment of the invention.

As shown in FIGS. 4 and 6, the diaphragm 3 has a circular or cylindrical radial cross section and is arranged in a cavity of the piston chamber 6. The diaphragm 3 comprises one diaphragm or a plurality of diaphragm assemblies, and the plurality of diaphragm assemblies enclose the piston chamber 6 to form the booster chamber 602. In an alternative solution, the diaphragm 3 comprises a first diaphragm 3*a*, a second diaphragm 3*b* and a third diaphragm 3*c* which are fan-shaped or arc-shaped, and the first diaphragm 3*a*, the second diaphragm 3*b* and the third diaphragm 3*c* are assembled into the diaphragm 3. The diaphragm 3 is made of an elastic material, such as rubber, and is arranged in the cavity of the piston chamber 6.

An outer wall of the diaphragm 3 is in close contact with the inner wall of the piston chamber 6 to form the water outlet chamber 601, the booster chamber 602 and the water inlet chamber 603 through enclosing. A part of the diaphragm 3 which encloses the booster chamber 602 swings radially as a deformation area to generate radial deformation, so that the volume of the booster chamber 602 can be expanded or compressed.

The diaphragm assembly and the piston chamber assembly have the same shape or different shapes.

The diaphragm 3 or the piston chamber 6 is integrated or assembled.

Figure 9:
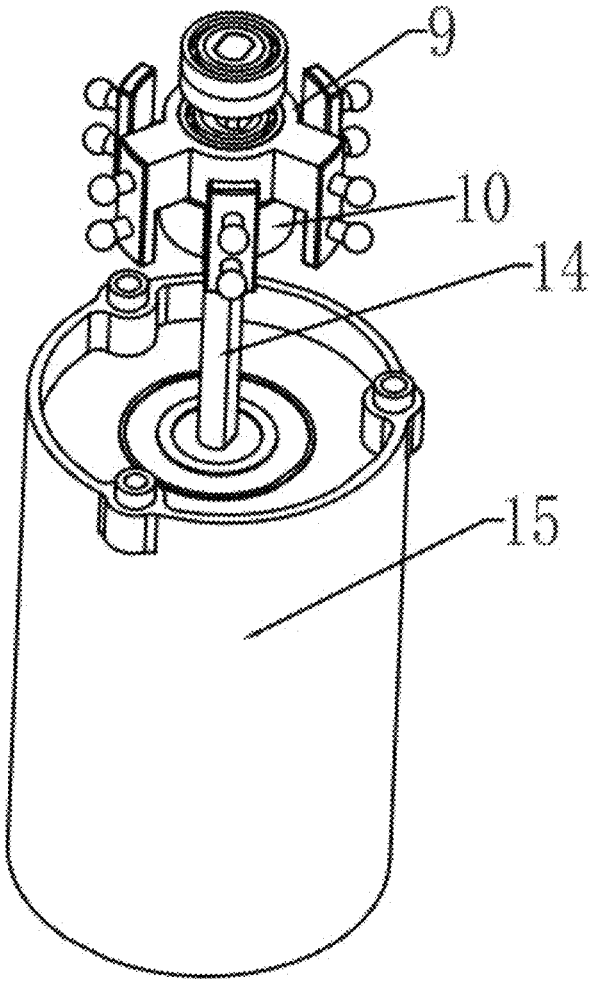
FIG. 9 is a diagram of a transmission unit of a diaphragm booster pump according to one embodiment of the invention.

As shown in FIGS. 4 and 9, a transmission assembly is used to drive the part of the diaphragm 3 which encloses the booster chamber to swing in a radial direction of the pump head. When the deformation area of the diaphragm 3 moves in an expansion direction, the water inlet check valve 4 opens, and source water enters through the water inlet hole 1301 of the water inlet block 13, enters the water inlet chamber 603 through the water inlet channel 1302, and is sucked into the booster chamber 602 through the water inlet 605. When the deformation area of the diaphragm 3 moves in a compression direction, the water outlet check valve 4 opens, and pressurized water in the booster chamber 602 is pressed into the water outlet chamber 601 through the water outlet 604, enters the water outlet block 1 through the water outlet channel 201, and is discharged through the water outlet hole 101.

The pump head of the diaphragm booster pump of this embodiment realizes the driving of water flow through the radial deformation of the diaphragm 3. Compared with the traditional diaphragm booster pump, the radial deformation of the diaphragm 3 can effectively increase the deformation area of the diaphragm and a variable volume of the booster chamber without changing a volume of a pump body and a rotation speed of the motor, so as to increase a flow rate of the diaphragm booster pump.

As shown in FIGS. 4 and 7, in this embodiment, a plurality of booster chambers 602 are arranged on the piston chamber 6, the number of the booster chambers 602 is preferably 6 or 10, and the plurality of booster chambers are oppositely arranged around a center point of the piston chamber into 3 pairs, 5 pairs or more pairs. The plurality of booster chambers 602 are arranged to meet the requirement for increasing the flow rate of the diaphragm booster pump, so that the working efficiency of the diaphragm booster pump can be improved. In this embodiment, the plurality of the booster chambers 602 are oppositely arranged along the inner wall of the piston chamber, that is, the plurality of the booster chambers 602 are oppositely arranged in pairs around the center point of the piston chamber. In a plan view, a center line of one booster chamber and a center line of the other booster chamber which is opposite thereto are located on a same diameter line of the piston chamber 6. In this embodiment, the number of the booster chambers 602 is 3 to 6, which can be adjusted by those skilled in the art as needed.

According to an alternative technical solution of this embodiment, two opposite booster chambers form a pair, and the plurality of pairs of booster chambers expand or compress in sequence under the driving of the transmission unit.

According to an alternative technical solution of this embodiment, the transmission unit of the pump head of the diaphragm booster pump of the invention comprises a pump head block 2, a first balance wheel 9, a second balance wheel 10, a first eccentric wheel bearing 7, a first eccentric wheel 8, a second eccentric wheel bearing 12, a second eccentric wheel 11 and a motor shaft 14.

The transmission unit is connected to the diaphragm 3, and drives the part of the diaphragm 3 which encloses the booster chamber to swing in the radial direction.

Figure 5:
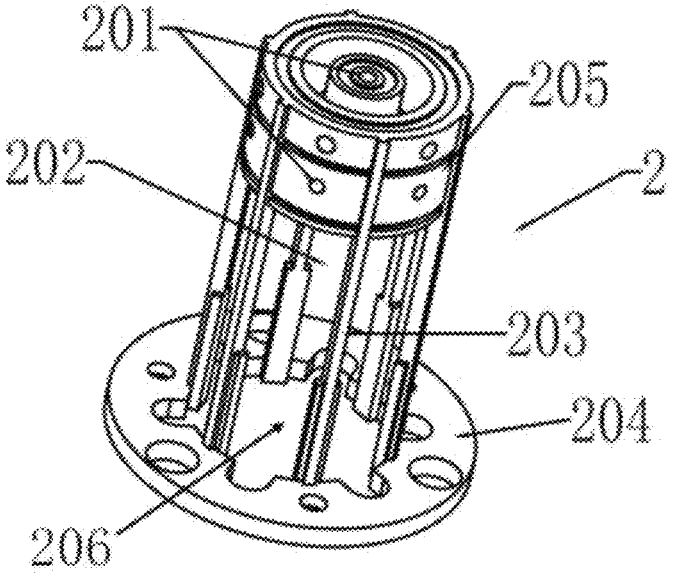
FIG. 5 is a diagram of a pump head block of a diaphragm booster pump according to one embodiment of the invention.

As shown in FIG. 5, the pump head block 2 is disposed in a second cavity 301 of the diaphragm 3. A side wall of a lower part of the pump head block 2 is provided with a balance wheel hole 202, which communicates with a third cavity 206, and an upper part of the pump head block 2 is provided with the water outlet channel 201 which communicates with the water outlet chamber 601 and the water outlet block 1.

Optionally, the pump head block 2 is provided with an upper water outlet structure 205 and a bracket 203, the bracket 203 is a frame-shaped structure provided with the balance wheel hole 202, and a block body 204 is provided with a water inlet block groove, which is connected to the water inlet block 13 in a suitable connection mode such as threads.

Figure 8:
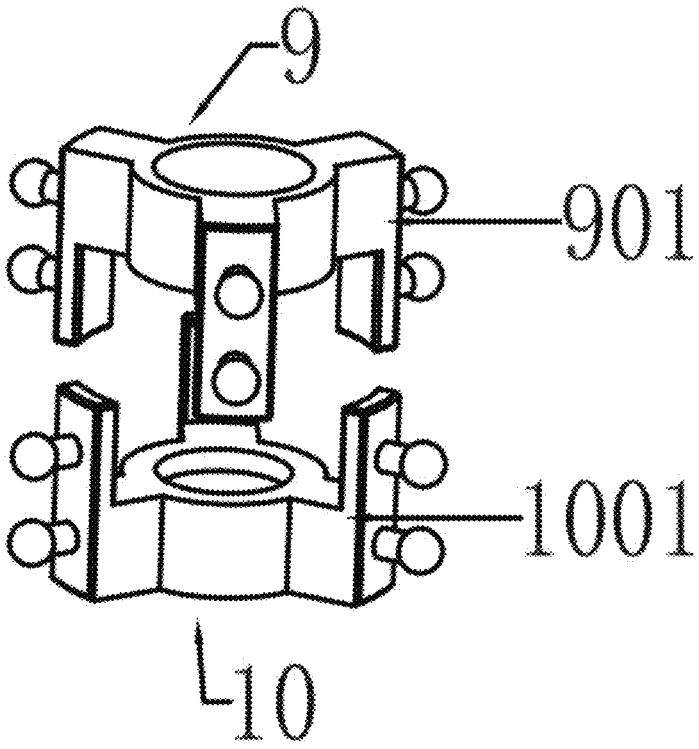
FIG. 8 is a diagram of a balance wheel assembly of a diaphragm booster pump according to one embodiment of the invention.
Figure 13:
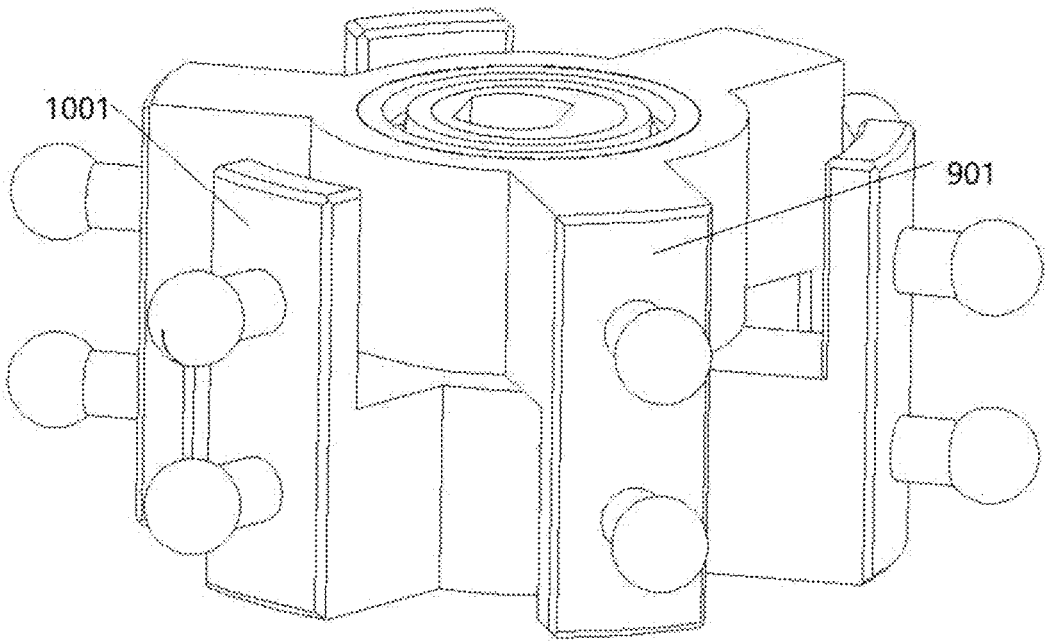
FIG. 13 is a structural diagram of a balance wheel assembly according to one embodiment of the invention.

As shown in FIGS. 8 and 13, the first balance wheel 9 and the second balance wheel 10 are arranged in the third cavity 206 of the pump head block 2, bearing holes are formed in the first balance wheel 9 and the second balance wheel 10, and outer walls of the first balance wheel 9 and the second balance wheel 10 are respectively provided with a first boss 901 and a second boss 1001. The first boss 901 is I-shaped, L-shaped, n-shaped or M-shaped, and the second boss 1001 is I-shaped, L-shaped, u-shaped or W-shaped. The shapes of the first boss 901 and the second boss 1001 are the same or different, and the first boss 901 and the second boss 1001 are oppositely arranged into a group to form a whole. The first boss 901 and the second boss 1001 are controlled by the first eccentric wheel and the second eccentric wheel respectively, and move in opposite directions.

The first boss 901 and the second boss 1001 can swing through the balance wheel hole 202 of the pump head block 2 in the radial direction. The first boss 901 and the second boss 1001 are connected to the diaphragm 3. When the first balance wheel 9 and the second balance wheel 10 swing in the radial direction, the diaphragm 3 is driven by the first boss 901 and the second boss 1001 to swing in the radial direction, thus realizing the expansion or compression of the booster chamber.

The number of the first bosses 901 and the second bosses 1001 is the same as that of the booster chambers 602, and each of the first bosses 901 and the second bosses 1001 corresponds to one booster chamber 602. In this embodiment, the number of the bosses is 6.

As shown in FIG. 4, the first eccentric wheel bearing 7 and the second eccentric wheel bearing 12 are arranged in the bearing holes of the first balance wheel 9 and the second balance wheel 10, and outer rings of the first eccentric wheel bearing 7 and the second eccentric wheel bearing 12 are respectively in close contact with inner walls of the first balance wheel 9 and the second balance wheel 11. In this embodiment, the first eccentric wheel bearing 7 and the second eccentric wheel bearing 12 are suitable parts such as ball bearings. Further, the outer rings of the first eccentric wheel bearing 7 and the second eccentric wheel bearing 12 are in interference fit with the inner walls of the first balance wheel 9 and the second balance wheel 10 respectively.

The first eccentric wheel 8 and the second eccentric wheel 11 are arranged in inner holes of the first eccentric wheel bearing 7 and the second eccentric wheel bearing 12, and the eccentric directions of the first eccentric wheel 8 and the second eccentric wheel 11 are opposite, that is, a thick part of the first eccentric wheel 8 corresponds to a thin part of the second eccentric wheel 11. When the motor shaft 14 rotates, the first balance wheel 9 and the second balance wheel 10 controlled by the first eccentric wheel 8 and the second eccentric wheel 11 move in opposite directions.

Figure 15:
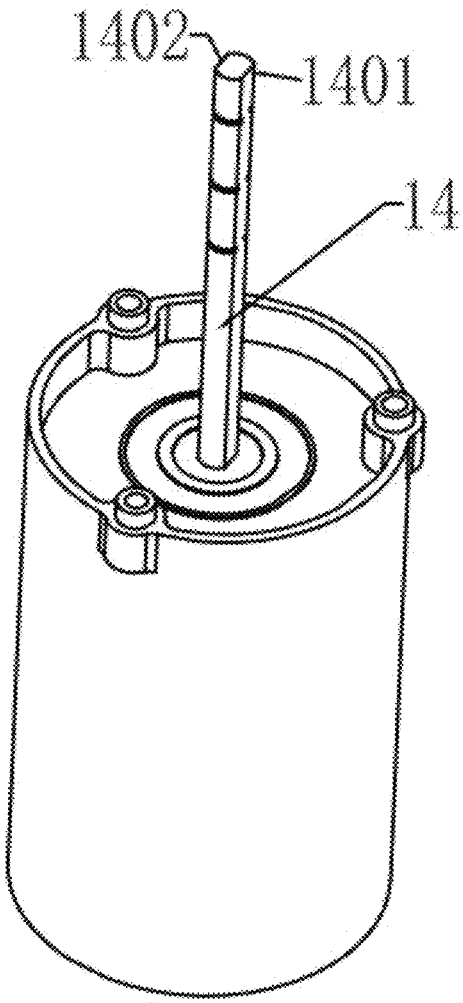
FIG. 15 is a diagram of a motor shaft of a diaphragm booster pump according to one embodiment of the invention.
Figure 16:
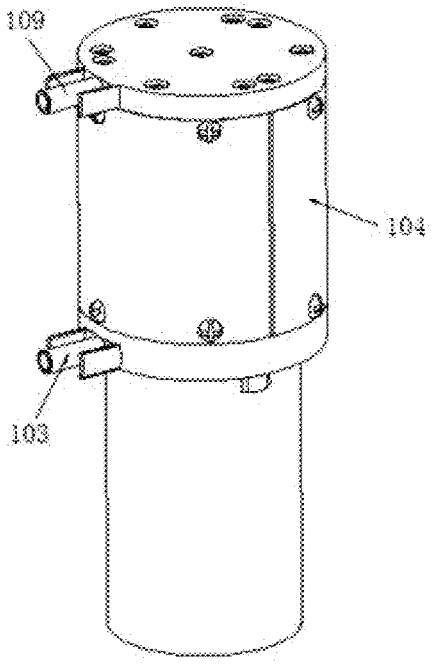
FIG. 16 is a diagram of a diaphragm booster pump according to another embodiment of the invention.
Figure 17:
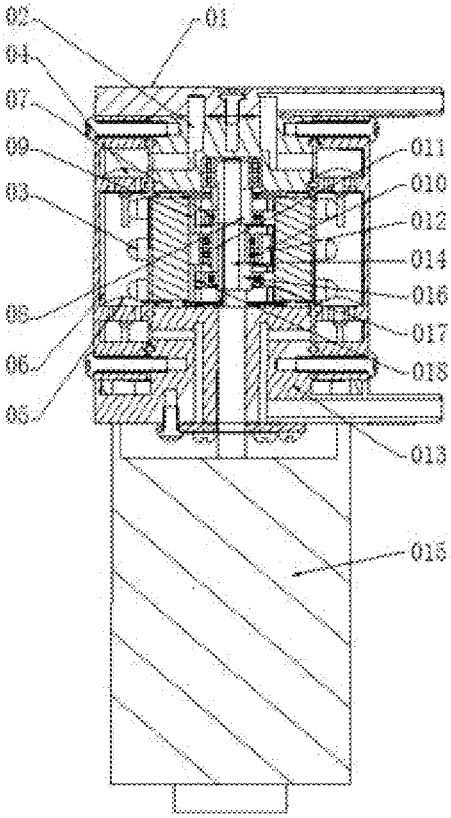
FIG. 17 is a sectional view of a diaphragm booster pump according to another embodiment of the invention.
Figure 18:
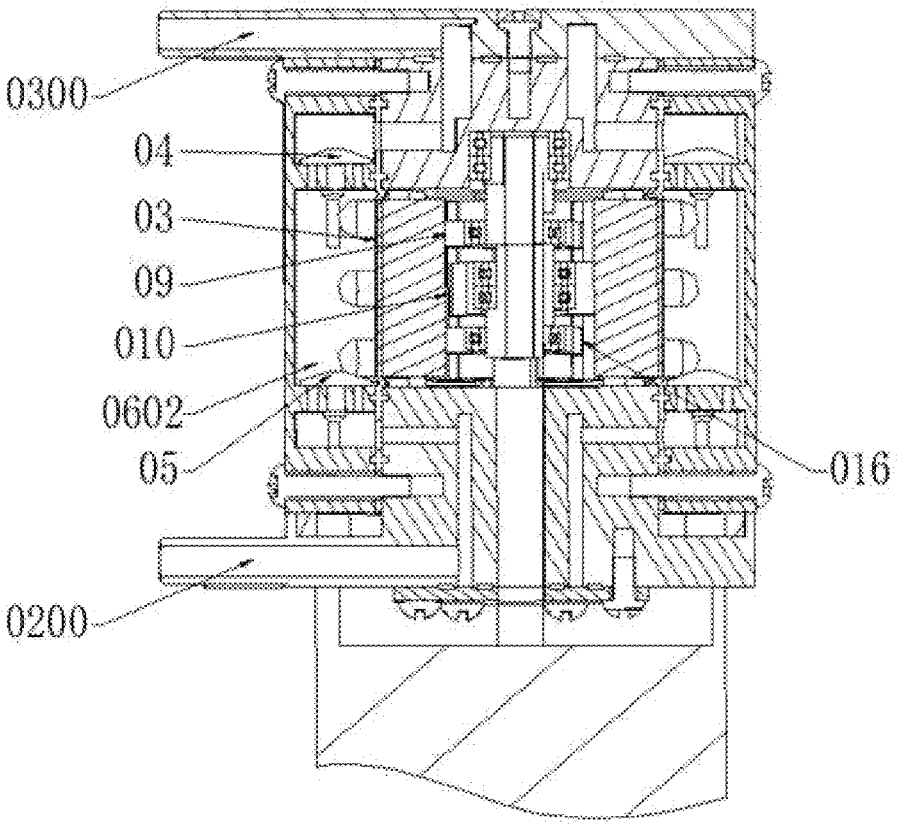
FIG. 18 is a sectional view of a diaphragm booster pump according to another embodiment of the invention.
Figure 19:
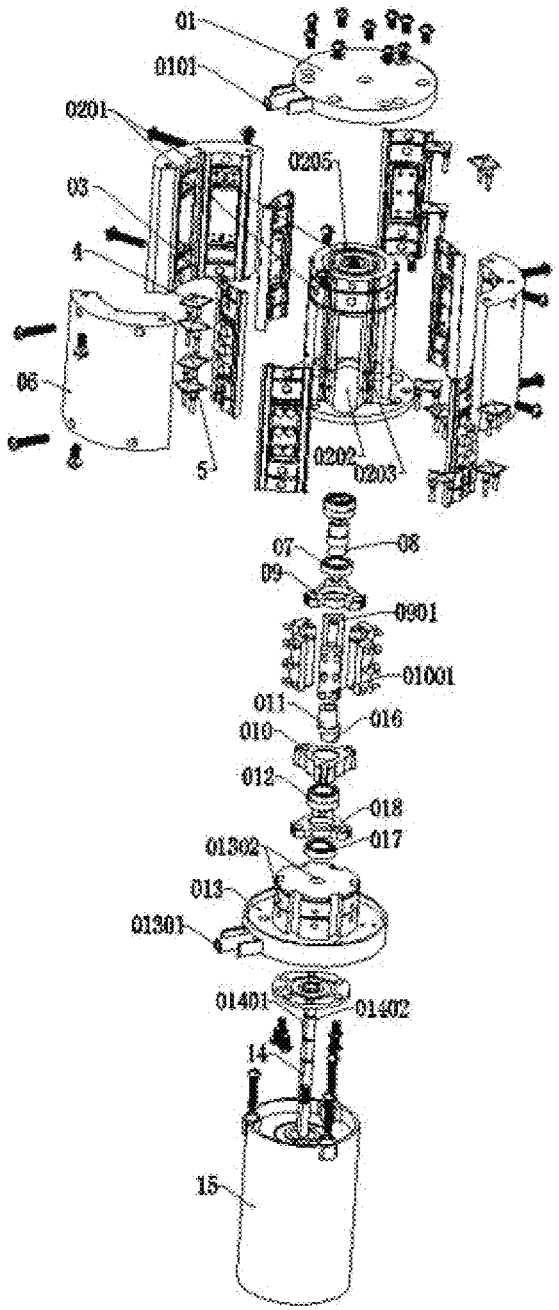
FIG. 19 is an exploded view of a diaphragm booster pump according to another embodiment of the invention.
Figure 20:
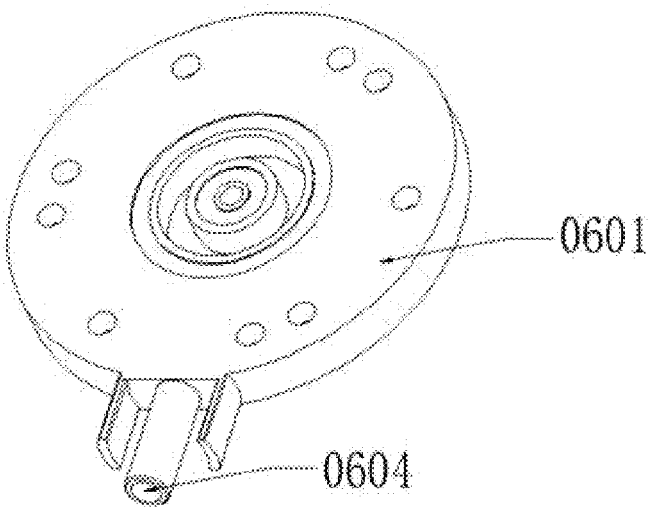
FIG. 20 is a diagram of a water outlet block of a diaphragm booster pump according to another embodiment of the invention.
Figure 21:
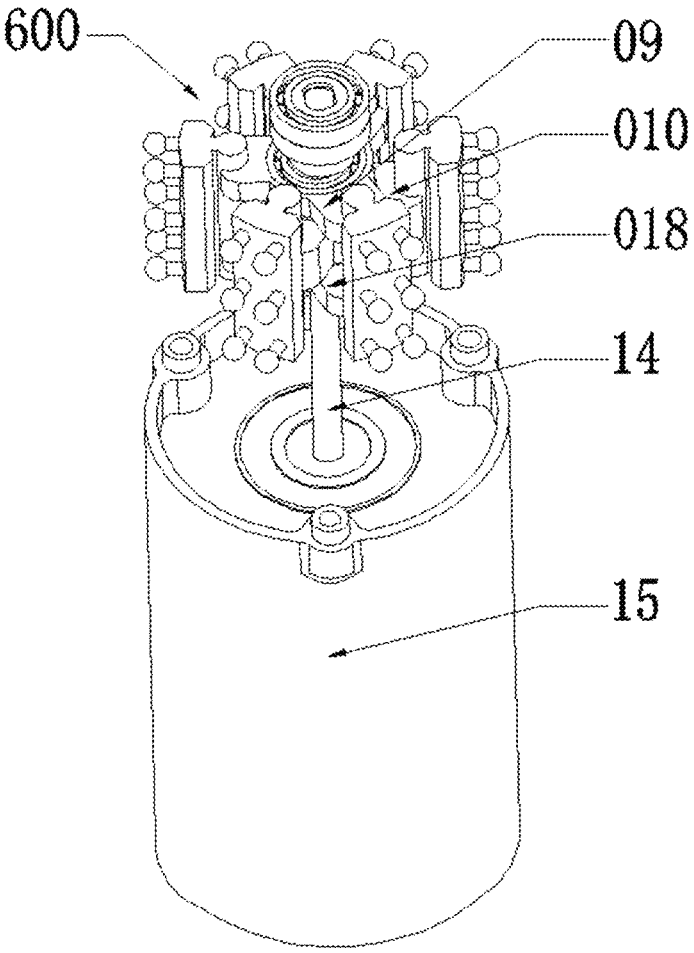
FIG. 21 is a diagram of a transmission assembly of a diaphragm booster pump according to another embodiment of the invention.
Figure 22:
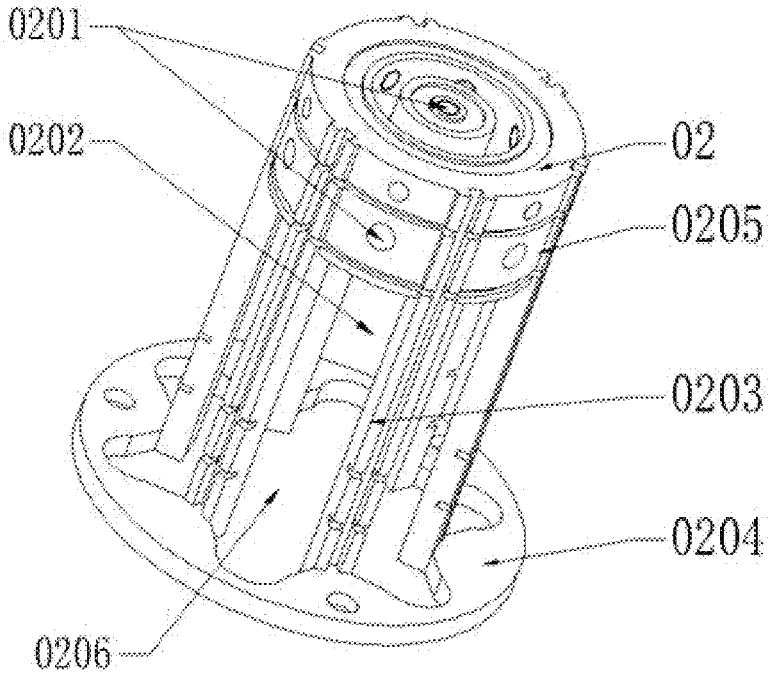
FIG. 22 is a diagram of a pump head block of a diaphragm booster pump according to another embodiment of the invention.

As shown in FIG. 15, the present invention lengthens a traditional motor shaft, and realizes an eccentric rotation by one concentric shaft and the opposite eccentric design of upper and lower eccentric wheels, so that the corresponding balance wheels are driven to move in opposite directions. A traditional D-shaped rotating shaft is provided with a cutting surface, which is used for clamping and fixing an inner side of an eccentric wheel. In this solution, a second cutting surface which is symmetrical with a first cutting surface is provided for the purpose of balance, the shape of the cutting surface is complementary to an inner ring of an eccentric wheel, and the dynamic balance of the rotating shaft is also ensured.

When the motor shaft 14 rotates, the first eccentric wheel 8 and the second eccentric wheel 11 rotate with the motor shaft 14, and the first balance wheel 9 and the second balance wheel 10 cannot rotate due to the restriction of the balance wheel hole 202 of the pump head block 2, and can only swing in the radial direction. The radial swing of the first balance wheel 9 and the second balance wheel 10 drives the diaphragm 3 to realize reciprocating expansion or compression.

The first balance wheel 9 and the second balance wheel 10 are respectively provided with bosses uniformly distributed along a circumference, and the bosses on the first balance wheel 9 and the bosses on the second balance wheel 10 are staggered at intervals, so that the bosses 901 and 1001 are oppositely staggered in pairs, that is, center lines of the bosses 901 and those of the bosses 1001 are located on a same diameter line of the piston chamber in a plan view.

The first eccentric wheel 8 and the second eccentric wheel 11 share the motor shaft 14, and the eccentric directions of the first eccentric wheel 8 and the second eccentric wheel 11 are opposite.

As the eccentric direction of the first eccentric wheel 8 is opposite to the eccentric direction of the second eccentric wheel 11, when the motor shaft 14 rotates, the first balance wheel 9 and the second balance wheel 10 swing in opposite directions in the radial direction at any time, so as to drive two opposite booster chambers in one pair to expand or compress synchronously in the radial direction in a reciprocating manner.

After the motor shaft 14 rotates by one circle, the deformation area of the diaphragm returns to an initial position, that is, the volume of the booster chamber is the largest, and the booster chamber expands in this process.

Therefore, every time the motor shaft 14 rotates by one circle, the booster chamber completes one expansion and compression cycle.

The same is true for the other two pairs of booster chambers. Every time the motor shaft 14 rotates by one circle, the three pairs of booster chambers complete one expansion and compression cycle.

Swing amplitudes of the first balance wheel 9 and the second balance wheel 10 are determined by eccentric distances of the first eccentric wheel 8 and the second eccentric wheel 11, which can vary with the pump volume. Swinging speeds of the first balance wheel and the second balance wheel are determined by the motor shaft, and the first balance wheel 9 and the second balance wheel 10 complete a reciprocating motion every time the motor shaft 14 rotates by one circle.

In this embodiment, through the cooperation of the transmission unit, the piston chamber 6 and the diaphragm 3, the booster chambers are arranged opposite to each other around the center point of the piston chamber in a centripetal manner, and two oppositely arranged booster chambers 602 are grouped into one pair. For example, six booster chambers 602 are divided into three pairs, and driven by the motor shaft 14, the first eccentric wheel 8 and the second eccentric wheel 11 to expand or compress in turn. The centripetal opposite arrangement structure of this embodiment ensures that a radial resultant force of the motor shaft 14 is zero during work, and achieves the purpose of reducing the vibration of the diaphragm booster pump and lowering noise.

As shown in FIG. 15, the motor shaft 14 of the invention is of a balanced and symmetrical structure, and two sides of the motor shaft 14 are symmetrically provided with the first cutting surface 1401 and the second cutting surface 1402, thus avoiding the unbalanced weight distribution of the traditional D-shaped motor shaft and further reducing the vibration of the diaphragm booster pump.

Figure 14:
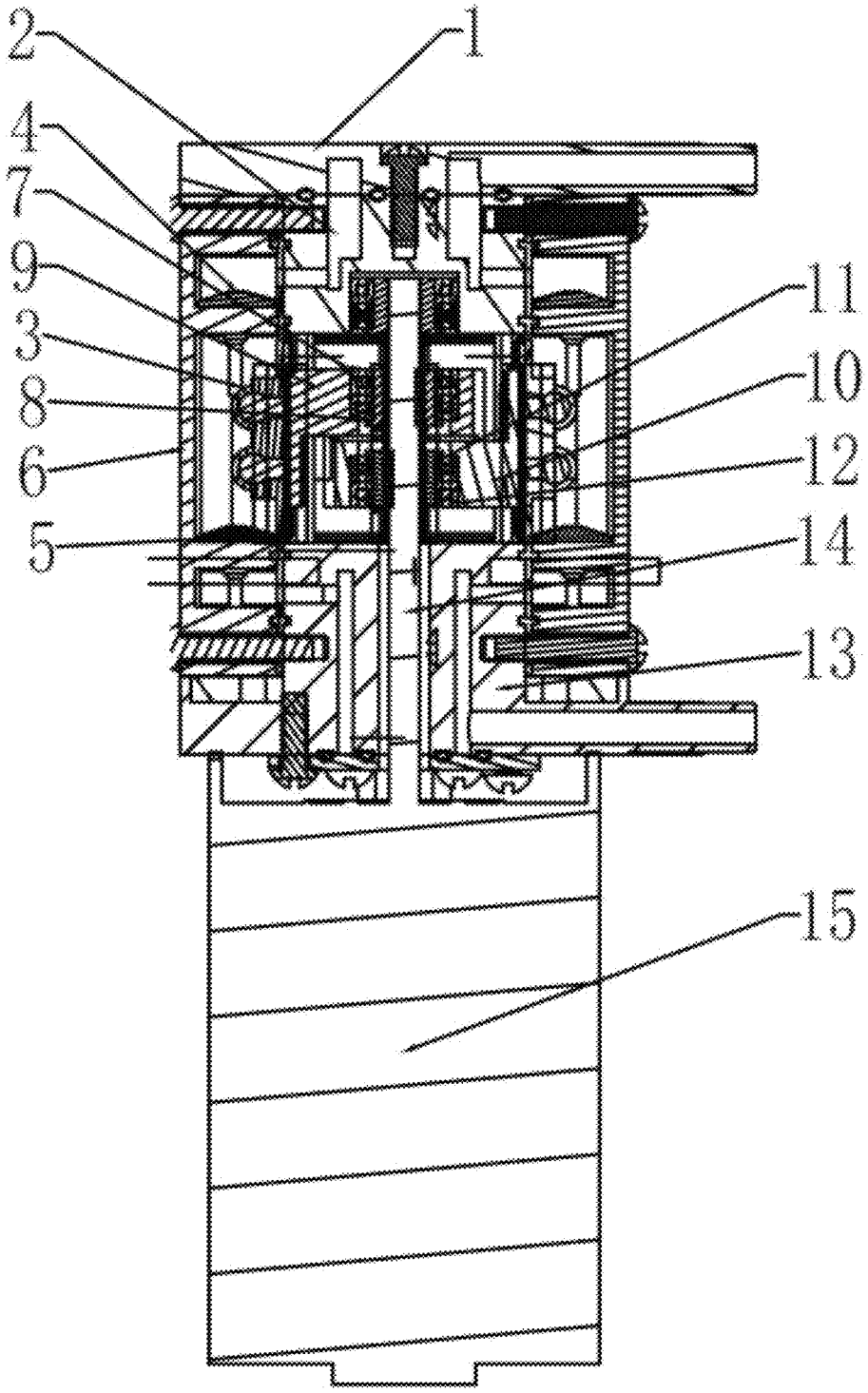
FIG. 14 is a sectional view of a diaphragm booster pump according to one embodiment of the invention.

As shown in FIGS. 4 and 14, the first balance wheel 9 and the second balance wheel 10 drive the deformation area of the diaphragm 3 to make reciprocating expansion or compression movement in the radial direction, so as to realize the radial expansion or compression of the booster chamber 602. When the deformation area of the diaphragm 3 moves in the expansion direction, the water inlet check valve 5 opens, and source water enters the water inlet chamber 603 via the water inlet channel 1302 through the water inlet hole 1301, and then is sucked into the booster chamber 602 through the water inlet 605. When the deformation area of the diaphragm 3 moves in the compression direction, the water outlet check valve 4 opens, and pressurized water is pressed out, enters the water outlet chamber 601 through the water outlet 604, enters the water outlet block 1 through the water outlet channel 201, and finally is discharged out of the pump through the water outlet hole 101 to provide required high-pressure water.

The first balance wheel and the second balance wheel drive each pair of oppositely arranged booster chambers to expand or compress at the same time, thus ensuring that the radial resultant force of the motor shaft 14 is zero during work, and reducing the vibration of the diaphragm booster pump.

As shown in FIGS. 4 and 14, a method of operating the pump head of the diaphragm booster pump is as follows: the transmission unit drives the deformation area of the diaphragm to make reciprocating expansion or compression movement in the radial direction, so that the booster chamber expands or compresses radially; when the deformation area of the diaphragm moves in the expansion direction, the water inlet check valve opens, and source water is sucked into the booster chamber through the water inlet chamber via the water inlet; and when the deformation area of the diaphragm moves in the compression direction, the water outlet check valve opens, and pressurized water is pressed out, enters the water outlet chamber through the water outlet, and is discharged from the water outlet chamber.

According to an alternative technical solution of the invention, in the method, the eccentric wheels are driven by a driving unit, the plurality of booster chambers are arranged opposite to each other around the center point of the piston chamber in a centripetal manner, two opposite booster chambers form a pair and driven by the eccentric wheels, and the plurality of pairs of booster chambers expand or compress in sequence.

According to an alternative technical solution of the invention, in the method, two balance wheels are arranged, and the first balance wheel and the second balance wheel swing in opposite directions under the action of the eccentric wheels, so that the radial resultant force of the motor shaft is zero.

The present invention also provides a diaphragm booster pump adopting the pump head of a diaphragm booster pump.

The present invention also provides a water treatment device adopting the diaphragm booster pump and the pump head of the invention and equipment comprising the water treatment device, such as a water filter, a water purifier, a filter, a coffee machine or the like.

Embodiment 2

This embodiment provides a six-cylinder opposed balanced diaphragm booster pump, which fundamentally solves the problem of large noise caused by vibration of an existing diaphragm pump in operation. The novel diaphragm pump keeps the radial stress balance, moment balance and dynamic balance of a rotating shaft at any time of operation, which greatly reduces the vibration and noise generated by the diaphragm pump in operation.

Figure 23:
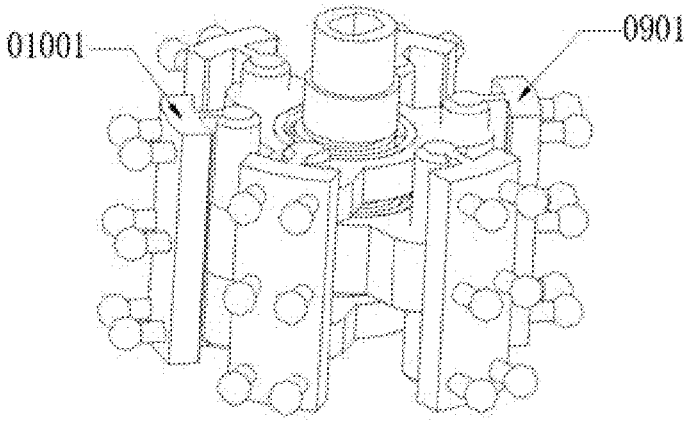
FIG. 23 is an assembly diagram of a balance wheel assembly of a diaphragm booster pump according to another embodiment of the invention.
Figure 24:
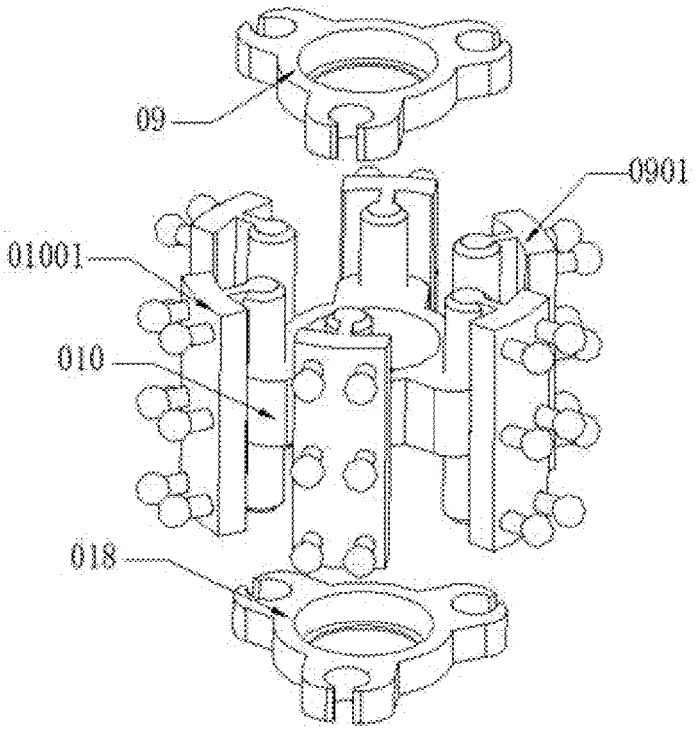
FIG. 24 is a structural diagram of a balance wheel assembly of a diaphragm booster pump according to another embodiment of the invention.
Figure 25:
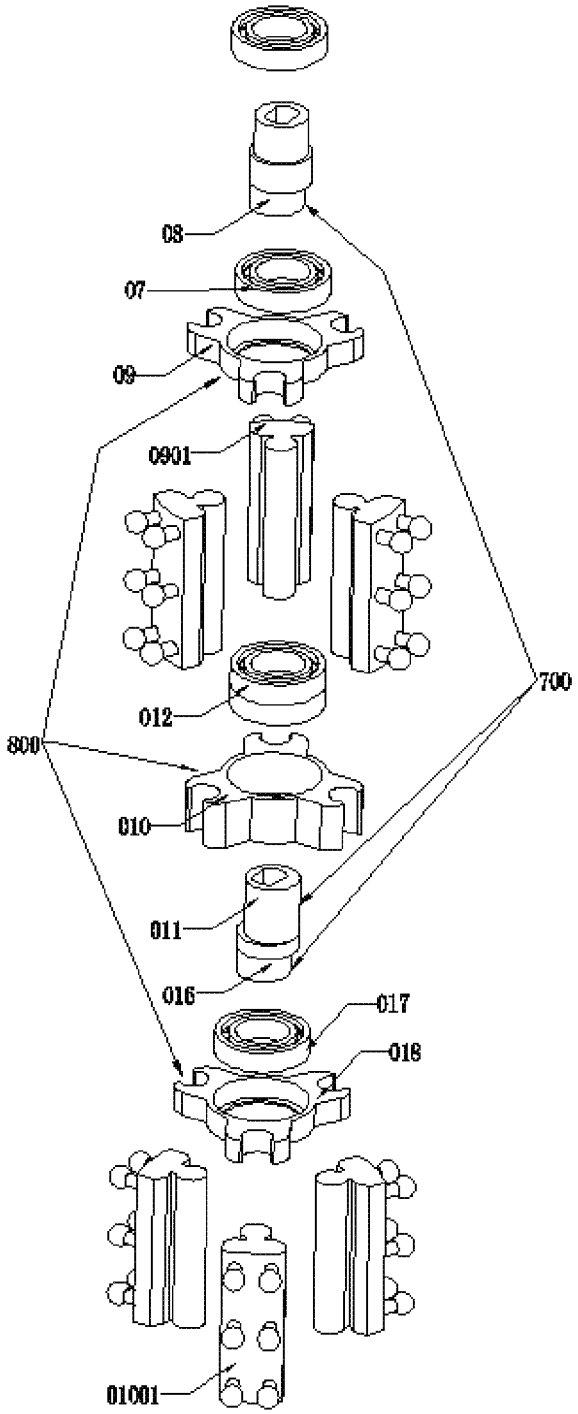
FIG. 25 is an exploded view of a transmission assembly of a diaphragm booster pump according to another embodiment of the invention.
Figure 26:
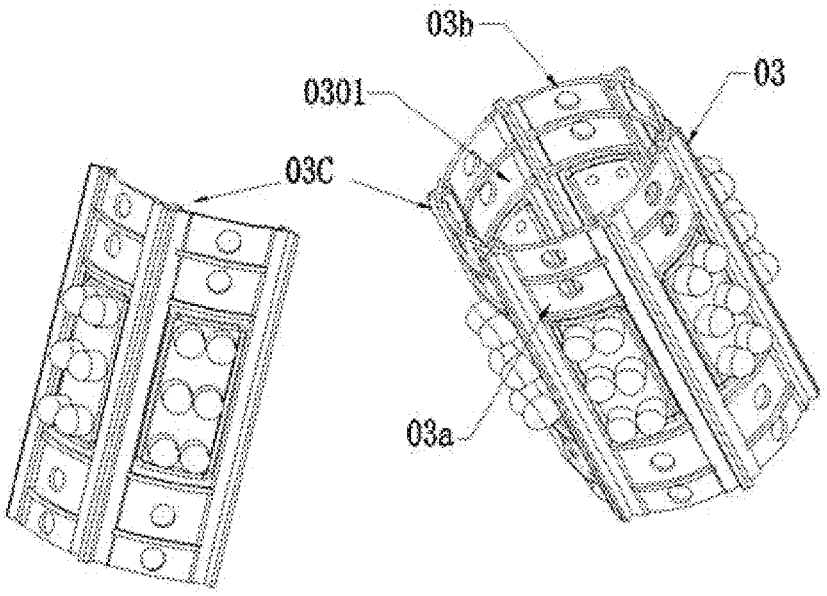
FIG. 26 is a structural diagram of a diaphragm of a diaphragm booster pump according to another embodiment of the invention.
Figure 27:
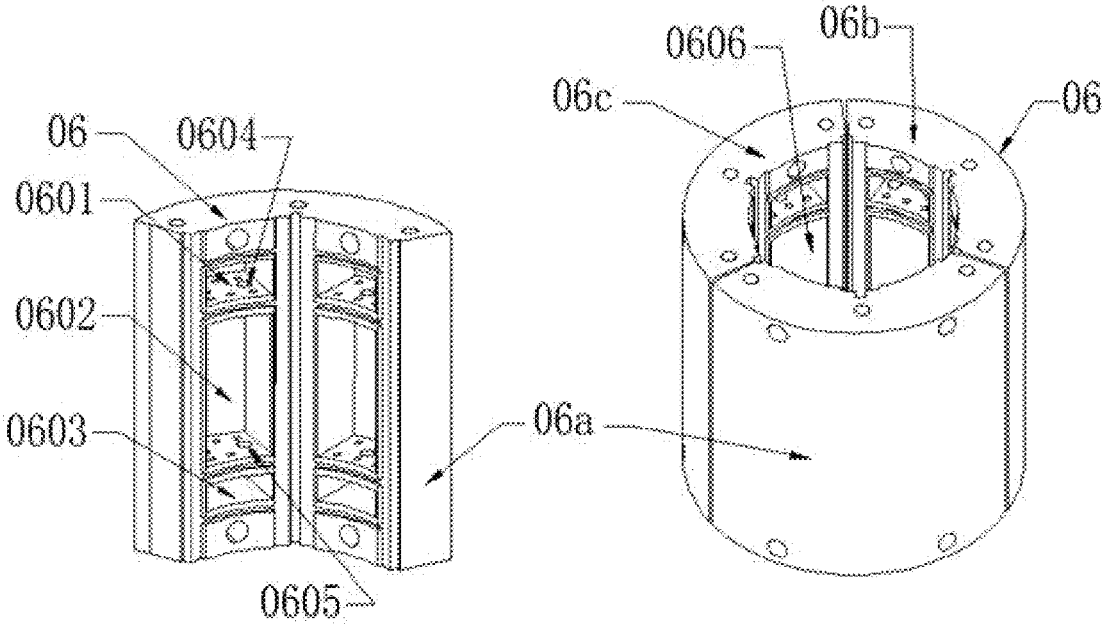
FIG. 27 is a structural diagram of a piston chamber of a diaphragm booster pump according to another embodiment of the invention.
Figure 28:
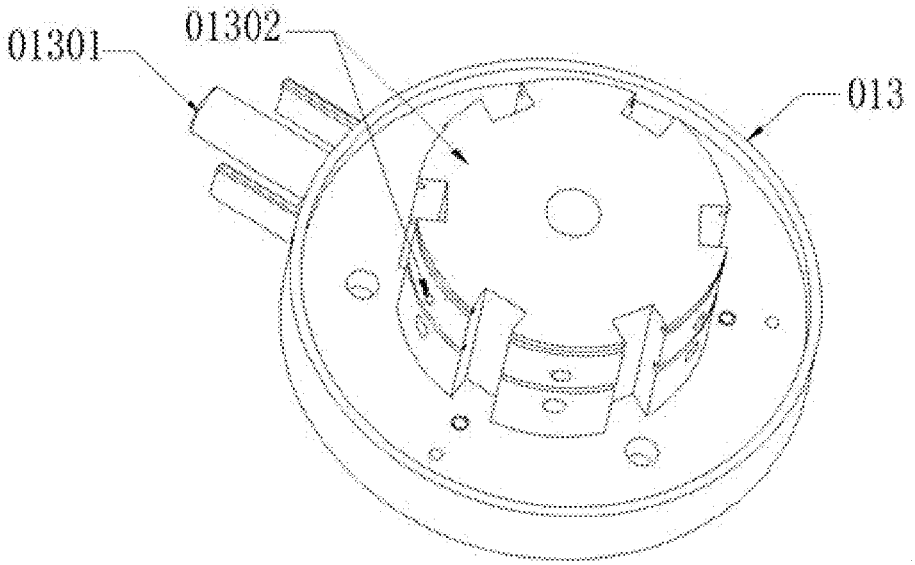
FIG. 28 is a diagram of a water inlet block of a diaphragm booster pump according to another embodiment of the invention.

The main function of this embodiment, noise reduction, is realized by a specially designed transmission assembly 600 which can keep the radial stress and moment of a rotating shaft balanced and keep the rotating shaft dynamically balanced at any time during work. As shown in FIG. 25, the transmission assembly consists of four bearings, a central shaft and an eccentric shaft fixed to a motor shaft, two small balance wheels, one big balance wheel and six swing arms (i.e., three first bosses 0901 and three second boss 01001) fixed to the balance wheels. The balance wheels are connected to the central shaft and the eccentric shaft by bearings. Three of the six swing arms (i.e., three first bosses 0901) are fixed to the two small balance wheels (i.e., the first balance wheel 09 and the third balance wheel 018), and the other three (i.e., three second boss 01001) are fixed to the big balance wheel (i.e., the second balance wheel 010) to form a split structure. The center shaft and the eccentric shaft form a rotating shaft assembly. The rotating shaft assembly is provided with two small cylindrical eccentric sections with the same eccentric direction and equal mass and a big cylindrical eccentric section. Eccentric directions of the small eccentric sections and the big eccentric section are opposite, and eccentric forces of the three eccentric sections counteract each other and moment balance is realized during rotation, so the dynamic balance can be achieved. Installation positions of the big and small balance wheels and connecting bearings are shown in FIG. 23. When the motor works, an eccentric part of the rotating shaft drives the balance wheels and the swing arms to swing eccentrically through four bearings. At this point, a movable part of a diaphragm sleeved on the swing arm will also swing eccentrically with the swing arm, so that the diaphragm completes the radial reciprocating piston movement to realize the boosting function. When the motor works, for the whole transmission assembly, a radial eccentric resultant force generated by the eccentric motion at the big balance wheel and the eccentric motion at the two small balance wheels is zero, and the resultant moment keeps balanced. Therefore, the whole transmission assembly is in a dynamically balanced state in operation, and the transmission assembly running smoothly generates no serious noise caused by radial vibration, thus achieving the purpose of noise reduction.

Six pairs of swing arms distributed symmetrically around a circumference can synchronously reciprocate through a group of eccentric wheels, that is, rotate by one circle, while a group of opposite eccentric swing arms synchronously reciprocate around the center shaft. Three groups of swing arms reciprocate once in every circle. When the reciprocating motion of each group of swing arms passes through the eccentric wheel and the balance wheel linked therewith, the eccentric wheel rotates around the center shaft to reach a highest point and a lowest point, and the diaphragm linked therewith deforms to realize the volume change in the booster chamber.

In Embodiment 1, although an axial opposite distribution structure is realized, and an axial synchronous opposite movement mode is also realized, the balance wheels are arranged in an opposite insertion mode, that is, axial distribution is symmetrical, but horizontal distribution is not on the same horizontal plane, which leads to a certain degree of vibration caused by unbalanced mass distribution during rotation, resulting in noise. For the transmission assembly in Embodiment 2, the balance wheels, the swing arms and the eccentric shaft are not only distributed symmetrically in the axial direction, but also distributed symmetrically in the horizontal direction. As shown in the diagram, the balance wheels are distributed symmetrically in both the axial direction and the horizontal direction, so that force balance, dynamic balance and moment balance can be kept during rotation, so as to minimize vibration and noise.

The structural features of Embodiment 2 will be described in detail below.

Reference marks: transmission assembly 600, eccentric assembly 700, balance wheel assembly 800, diaphragm booster pump 104, water outlet block 01, pump head block 02, diaphragm 03, water outlet check valve 04, water inlet check valve 05, piston chamber 06, first eccentric wheel bearing 07, first eccentric wheel 08, first balance wheel 09, second balance wheel 010, second eccentric wheel 011, second eccentric wheel bearing 012, water inlet block 013, motor shaft 014, motor 015, third eccentric wheel 016, third eccentric wheel bearing 017, third balance wheel 018, pressurized water 0300, booster chamber 0602, source water 0200, motor shaft 014, motor 015, water outlet channel 0201, balance wheel hole 0202, bracket 0203, water outlet structure 0205, first boss 0901, second boss 01001, water inlet hole 01301, water inlet channel 01302, first cutting surface 01401, second cutting surface 01402, water outlet 0604, water outlet chamber 0601, block body 0204, water outlet structure 0205, third cavity 0206, diaphragm 03, first diaphragm 03*a*, second diaphragm 03*b*, third diaphragm 03*c*, second cavity 0301, first piston chamber 06*a*, second piston chamber 06*b*, third piston chamber 06*c*, water inlet chamber 0603, water inlet 0605 and first cavity 0606.

A movement of two eccentric wheels with a phase difference of 180° in the eccentric assembly 700 drives balance wheels of the balance wheel assembly to move oppositely.

During rotation of the eccentric assembly 700, eccentric forces counteract each other, and moment balance is realized.

A resultant force of radial eccentric forces generated by the eccentric movement of the balance wheel assembly 800 is zero, and resultant moment balance is realized.

The eccentric assembly 700 comprises a first eccentric wheel 08, a second eccentric wheel 011 and a third eccentric wheel 016 in sequence, the first eccentric wheel 08 and the third eccentric wheel 016 are similarly eccentric, and the second eccentric wheel 011 is eccentric in an opposite manner to the first eccentric wheel 08 and the third eccentric wheel 016.

The balance wheel assembly comprises a big balance wheel and small balance wheels, which are a first balance wheel 09 (also referred to as first small balance wheel), a second balance wheel 010 (also referred to as big balance wheel) and a third balance wheel 018 (also referred to as second small balance wheel) in sequence, and the eccentric assembly 700 drives the balance wheel assembly 800 to swing eccentrically through eccentric wheel bearings 07, 012, 017.

The transmission assembly 600 of the pump head comprises a central shaft fixed to the motor shaft 14, the eccentric assembly 700, the balance wheel assembly 800, the eccentric wheel bearings 07, 012, 017, and swing arms fixed to the balance wheel assembly 800.

A part of the swing arms are fixed to the small balance wheels 09, 018, and another part of the swing arms are fixed to the big balance wheel 010 to form a split structure.

Two of the booster chambers 0602 oppositely arranged around a center point of the piston chamber form a pair, and center lines of the pair of the booster chambers 0602 are on a same diameter line of the piston chamber.

At least three pairs of the booster chambers 0602 expand or compress in sequence. Every time the motor shaft 14 rotates by one circle, the booster chambers 0602 complete one expansion and compression cycle.

A radial reciprocating motion of the balance wheels 09, 010, 018 of the balance wheel assembly 800 drives the diaphragms 03*a*, 03*b*, 03*c* to radially deform, so that the booster chamber 0602 radially expands or compresses.

Contact parts between the diaphragms 03*a*, 03*b*, 03*c* and the swing arms of the balance wheels are deformation area of the diaphragms, and the deformation area of the diaphragms are deformed.

The small balance wheels 09, 018 and the big balance wheel 010 simultaneously deviate from or move towards an axial center of the motor shaft 14, forces in a radial direction counteract each other, and a resultant force is zero.

When thin parts of the first eccentric wheel 08 and the third eccentric wheel 016 rotate to the balance wheels linked therewith, the small balance wheels 09, 018 the deformation area of the diaphragm corresponding to the small balance wheels 09, 018 to be near a center point of the piston chamber 06, and the volume of the booster chamber corresponding to the small balance wheels 09, 018 is the largest; and an eccentric position of the second eccentric wheel 011 is opposite to eccentric positions of the first eccentric wheel 08 and the third eccentric wheel 016, so when a thin part of the second eccentric wheel 011 rotates to the big balance wheel 010 linked therewith, the corresponding deformation area of the diaphragm is near the center point of the piston chamber 06, and the volume of the booster chamber 0602 is the largest.

When thick parts of the first eccentric wheel 08 and the third eccentric wheel 016 rotate to the small balance wheels 09, 018 linked therewith, the deformation area of the diaphragm corresponding to the balance wheel is away from the center point of the piston chamber 06, and the volume of the booster chamber 0602 is the smallest; and when a thick part of the second eccentric wheel 011 rotates to the big balance wheel 010 linked therewith, the corresponding deformation area of the diaphragm is away from the center point of the piston chamber 06, and the volume of the booster chamber 0602 is the smallest.

The motor shaft 14 has a first cutting surface 01401 and a second cutting surface 01402 which is symmetrical with the first cutting surface to realize balance.

When the diaphragms 03*a*, 03*b*, 03*c* move in an expansion direction, a water inlet check valve 05 opens and source water is sucked into the booster chambers 0602; and when the diaphragms 03*a*, 03*b*, 03*c* move in a compression direction, a water outlet check valve 04 opens and pressurized water is discharged.

The diaphragm 03 comprises at least one diaphragm or a plurality of diaphragm 03*a*, 03*b*, and 03*c* assemblies, which are assembled into the diaphragm.

The piston chamber 06 comprises at least one piston chamber assembly 06*a*, 06*b*, 06*c*, and a plurality of piston chamber assemblies are assembled into the piston chamber.

The diaphragm 03 or 03*a*, 03*b*, 03*c* or the piston chamber 06 or 06*a*, 0*b*6, 06*c* is integrated or assembled.

The diaphragm 03 or 03*a*, 03*b*, 03*c* is attached to an inner wall of the piston chamber 06 or 06*a*, 06*b*, 06*c* to form a water outlet chamber 0601, the booster chamber 0602, and a water inlet chamber 0603 through enclosing.

A diaphragm booster pump comprising the pump head of a diaphragm booster pump is provided.

A water treatment device comprising the diaphragm booster pump is provided.

A method of operating the pump head of the diaphragm booster pump is as follows: the transmission unit drives the deformation area of the diaphragm to expand or compress radially; during the rotation of the eccentric assembly, eccentric forces counteract each other, and moment balance is realized; a resultant force of radial eccentric forces generated by the eccentric movement of the balance wheel assembly is zero, and resultant moment balance is realized, so that the booster chambers expand or compress radially; when the deformation area of the diaphragm moves in the expansion direction, the water inlet check valve opens, and source water is sucked into the booster chambers from a water inlet chamber via a water inlet; and when the deformation area of the diaphragm moves in the compression direction, the water outlet check valve opens, and pressurized water is pressed out, enters a water outlet chamber through a water outlet, and is discharged from the water outlet chamber.

Further, a plurality of booster chambers are arranged opposite to each other around the center point of the piston chamber in a centripetal manner, two opposite booster chambers form a pair and are driven by the eccentric assembly, and the plurality of pairs of booster chambers expand or compress in sequence.

The embodiments of the application have been introduced in detail above. Specific examples are applied herein to illustrate the principle and implementation of the application. The above embodiments are only used to help understand the technical solution of the application and its core ideas. The changes or deformations made by those skilled in the art based on the ideas of the application and the specific implementation and application scope of the application are within the scope of protection of the application. To sum up, the content of this specification should not be construed as a limitation of the application.

What is claimed is:

1. A transmission assembly for a pump head of a diaphragm booster pump, comprising:

an eccentric assembly, comprising a motor shaft and eccentric wheels, the eccentric wheels comprising a first eccentric wheel, a second eccentric wheel and a third eccentric wheel in sequence, the first eccentric wheel and the third eccentric wheel being similarly eccentric, and the second eccentric wheel being eccentric in an opposite manner to the first eccentric wheel and the third eccentric wheel;

a balance wheel assembly, comprising balance wheels, the balance wheels comprising a first balance wheel, a second balance wheel and a third balance wheel in sequence, and the second balance wheel is bigger than the first balance wheel and the third balance wheel;

a bearing; and bosses, fixed to the balance wheels, comprising first bosses and second bosses;

wherein movement of the first eccentric wheel and the second eccentric wheel or movement of the second eccentric wheel and the third eccentric wheel drives the balance wheels of the balance wheel assembly to move oppositely, the eccentric wheels are sleeved on the motor shaft and rotate along with the motor shaft;

the eccentric assembly drives the balance wheel assembly to swing eccentrically through the bearing;

each of the first bosses is fixed to the first balance wheel and the third balance wheel simultaneously, and each of the second bosses is fixed to the second balance wheel, so that to form a split structure.

2. The transmission assembly according to claim 1, wherein during rotation of the eccentric assembly, eccentric forces counteract each other, and moment balance is realized.

3. The transmission assembly according to claim 1, wherein a resultant force of radial eccentric forces generated by an eccentric movement of the balance wheel assembly is zero, and resultant moment balance is realized.

4. The transmission assembly according to claim 1, wherein the first balance wheel, the second balance wheel or the second eccentric wheel and the third eccentric wheel simultaneously deviate from or move towards an axial center of the motor shaft, such that forces applied to the motor shaft in a radial direction counteract each other, and a resultant force is zero.

5. The transmission assembly according to claim 1, wherein the balance wheel assembly drives booster chambers to expand or compress radially, and the booster chambers are connected to a diaphragm and a piston chamber.

6. The transmission assembly according to claim 5, wherein two of the booster chambers oppositely arranged around a center point of the piston chamber form a pair.

7. The transmission assembly according to claim 5, wherein at least three pairs of the booster chambers expand or compress in sequence.

8. The transmission assembly according to claim 5, wherein the booster chambers completes one expansion and compression cycle every time the motor shaft rotates once.

9. The transmission assembly according to claim 5, wherein a radial reciprocating movement of the balance wheels of the balance wheel assembly drives the diaphragm to be radially deformed, so that the booster chambers expands or compresses radially.

10. The transmission assembly according to claim 5, wherein a contact parts between the diaphragm and the bosses are a deformation area of the diaphragm, and the deformation area of the diaphragm is deformed during operation.

11. The transmission assembly according to claim 10, wherein the first eccentric wheel, the second eccentric wheel and the third eccentric wheel each has a thinner part and a thicker part, when the thinner part of the first eccentric wheel or the third eccentric wheel rotates to the balance wheels, the first balance wheel or the third balance wheel pushes the deformation area of the diaphragm corresponding to the first balance wheel or the third balance wheel to be near a center point of the piston chamber, and a volume of the booster chamber corresponding to the first balance wheel or the third balance wheel is the largest; and an eccentric position of the second eccentric wheel is opposite to eccentric positions of the first eccentric wheel and the third eccentric wheel, so when the thinner part of the second eccentric wheel rotates to the second balance wheel, the corresponding deformation area of the diaphragm is near the center point of the piston chamber, and the volume of the booster chamber is the largest.

12. The transmission assembly according to claim 11, wherein when the thicker parts of the first eccentric wheel or the third eccentric wheel rotates to the first balance wheel or the third balance wheel, the deformation area of the diaphragm corresponding to the first balance wheel or the third balance wheel is away from a center point of the piston chamber, and a volume of the booster chamber is the smallest; and when the thicker part of the second eccentric wheel rotates to the second balance wheel, the corresponding deformation area of the diaphragm is away from the center point of the piston chamber, and the volume of the booster chamber is the smallest.

13. The transmission assembly according to claim 5, wherein when the diaphragm moves in an expansion direction, a water inlet check valve opens and source water is sucked into the booster chambers; and when the diaphragm moves in a compression direction, a water outlet check valve opens and pressurized water is discharged.

14. A pump head of a diaphragm booster pump, comprising the transmission assembly according to claim 1.

15. A diaphragm booster pump, comprising the pump head according to claim 14.

* * * * *